US009120992B2

(12) United States Patent
Nakao et al.

(10) Patent No.: US 9,120,992 B2
(45) Date of Patent: Sep. 1, 2015

(54) GEAR OIL COMPOSITION

(75) Inventors: Hajime Nakao, Tokyo (JP); Hitoshi Komatsubara, Tokyo (JP)

(73) Assignee: JX Nippon Oil & Energy Corporation, Tokyo (JP)

( * ) Notice: Subject to any disclaimer, the term of this patent is extended or adjusted under 35 U.S.C. 154(b) by 0 days.

(21) Appl. No.: 13/881,177

(22) PCT Filed: Sep. 13, 2011

(86) PCT No.: PCT/JP2011/070812

§ 371 (c)(1),
(2), (4) Date: Apr. 24, 2013

(87) PCT Pub. No.: WO2012/124189

PCT Pub. Date: Sep. 20, 2012

(65) Prior Publication Data

US 2013/0345103 A1 Dec. 26, 2013

(30) Foreign Application Priority Data

Mar. 16, 2011 (JP) ..... 2011-057437

(51) Int. Cl.
*C10M 137/10* (2006.01)
*C10M 141/10* (2006.01)
*C10M 169/04* (2006.01)

(52) U.S. Cl.
CPC ..... *C10M 169/04* (2013.01); *C10M 169/045* (2013.01); *C10M 2203/1006* (2013.01); *C10M 2203/1025* (2013.01); *C10M 2207/028* (2013.01); *C10M 2207/262* (2013.01); *C10M 2207/2805* (2013.01); *C10M 2207/2835* (2013.01); *C10M 2209/084* (2013.01); *C10M 2219/022* (2013.01); *C10M 2219/046* (2013.01); *C10M 2223/045* (2013.01); *C10N 2210/02* (2013.01); *C10N 2220/022* (2013.01); *C10N 2230/06* (2013.01); *C10N 2230/10* (2013.01); *C10N 2230/54* (2013.01); *C10N 2240/04* (2013.01)

(58) Field of Classification Search
CPC ..... C10M 2223/045; C10M 2219/046; C10M 2207/281; C10M 2203/1006
USPC ..... 508/371, 372, 378
See application file for complete search history.

(56) References Cited

U.S. PATENT DOCUMENTS

| | | | | |
|---|---|---|---|---|
| 2005/0143266 | A1* | 6/2005 | Yagishita | 508/294 |
| 2006/0135378 | A1 | 6/2006 | Takahashi et al. | |
| 2008/0110799 | A1 | 5/2008 | Matsui et al. | |
| 2009/0131291 | A1 | 5/2009 | Kurosawa et al. | |
| 2010/0144571 | A1* | 6/2010 | Shirahama et al. | 508/465 |
| 2011/0034358 | A1* | 2/2011 | Komatsubara | 508/459 |

FOREIGN PATENT DOCUMENTS

| | | | |
|---|---|---|---|
| JP | 03-039399 | A | 2/1991 |
| JP | 07-268375 | A | 10/1995 |
| JP | 2000-063869 | A | 2/2000 |
| JP | 2004-262979 | A | 9/2004 |
| JP | 2008-120908 | A | 5/2008 |
| JP | 2008-120909 | A | 5/2008 |
| WO | 2007001000 | A1 | 1/2007 |

OTHER PUBLICATIONS

Int'l Search Report issued Oct. 18, 2011 in Int'l Application No. PCT/JP2011/070812.
Extended European Search Report issued Sep. 22, 2014 in EP Application No. 11860816.5.

* cited by examiner

*Primary Examiner* — Vishal Vasisth
(74) *Attorney, Agent, or Firm* — Panitch Schwarze Belisario & Nadel LLP

(57) ABSTRACT

A gear oil composition is provided having fuel saving performance and providing gears or bearings with sufficient durability. The composition includes a base oil having a blend of (A) a mineral lubricating base oil having a 100° C. kinematic viscosity of 2 to 6 $mm^2/s$, a % CA of 0.5 or less and a tertiary carbon content of 7% or more and (B) a solvent-refined mineral lubricating oil having a 100° C. kinematic viscosity of 10 to 70 $mm^2/s$ in an amount of 2 to 40 percent by mass based on the total base oil composition mass; (D) zinc dialkyldithiophosphate in an amount of 0.02 to 0.5 percent by mass based on the zinc amount; and (E) an alkaline earth metal detergent having a base number of 100 mgKOH/g or greater in an amount of 0.1 to 0.5 percent by mass, based on the metal amount, of the gear oil composition mass.

5 Claims, No Drawings

GEAR OIL COMPOSITION

CROSS-REFERENCE TO RELATED APPLICATION

This application is a Section 371 of International Application No. PCT/JP2011/070812, filed Sep. 13, 2011, which was published in the Japanese language on Sep. 20, 2012, under International Publication No. WO 2012/124189 A1, and the disclosure of which is incorporated herein by reference.

TECHNICAL FIELD

The present invention relates to lubricating oil compositions for gears (gear oil composition), more specifically to such lubricating oil compositions suitable for automobile gear units, in particular manual transmissions and final reduction gear units, having a low viscosity but providing the units with excellent fatigue life and extreme pressure properties, which do not degrade even after long time use.

BACKGROUND ART

Recently, energy saving in automobiles and construction or agricultural machinery, i.e., fuel saving has become an urgent need in order to deal with environmental issues such as reduction in carbon dioxide emissions, and units such as engines, transmissions, final reduction gears, compressors, or hydraulic power units have been strongly demanded to contribute to the energy saving. Consequently, the lubricating oils used in these systems are required to reduce stir resistance and frictional resistance more than before.

Reduction of the viscosity of a lubricating oil used in a transmission and a final reduction gear unit can be exemplified as an effective energy saving means. For example, a manual transmission or a final reduction gear unit has a gear bearing mechanism. Reduction of the viscosity of a lubricating oil to be used therein can reduce the stir and frictional resistances and thus enhance the power transmission efficiency, resulting in an improvement in the fuel efficiency of an automobile.

However, reduction of the viscosity of the lubricating oil used in these transmissions and units may cause the above-described units and mechanisms thereof to be significantly shortened in fatigue life or reduced in extreme pressure properties and may generate seizure, possibly resulting in some malfunctions in the transmissions. In particular when a low viscosity lubricating oil is blended with a phosphorus-based extreme pressure additive to enhance the extreme pressure properties of gears, the fatigue life thereof will be extremely shortened. In general it is thus difficult to reduce the viscosity of the lubricating oil. Alternatively, a viscosity index improver can improve the viscosity characteristics of a lubricating oil at low temperatures or practical temperatures but is not generally expected to improve the fatigue life or extreme pressure properties but also known to cause the viscosity to be reduced due to shear occurring during the long time use when the viscosity index improver is used in a lubrication oil for transmissions.

Examples of conventional automobile transmission oils which enable a transmission to maintain various properties such as shifting properties for a long time include those produced by optimizing and blending synthetic and/or mineral base oils, antiwear agents, extreme pressure additives, metallic detergents, ashless dispersants, friction modifiers and viscosity index improvers (for example, see Patent Literature Nos. 1 to 3 below).

However, these compositions do not aim at improving the fuel efficiency of an automobile and thus are high in kinematic viscosity. Any of the documents does not at all refers to the influences on fatigue life or extreme pressure properties in an early stage and after a long time use when the lubricating composition is lowered in viscosity. Therefore, a composition which can solve the foregoing problems has not been sufficiently studied yet.

CITATION LIST

Patent Literature

[Patent Literature 1] Japanese Patent Application Laid-Open Publication No. 3-39399

[Patent Literature 2] Japanese Patent Application Laid-Open Publication No. 7-268375

[Patent Literature 3] Japanese Patent Application Publication No. 2000-63869

SUMMARY OF INVENTION

Technical Problem

The present invention was made in view of these circumstances and has an object to provide a gear oil composition capable of providing a long fatigue life even though having a low viscosity and also extreme pressure properties initially or even after a long time use, and in particular such a composition suitable for use in automobile manual transmissions or final reduction gear units, having a fuel saving performance and providing gears or bearings with sufficient durability.

Solution to Problem

As the result of extensive study and research, the present invention was accomplished on the basis of the finding that the above problems were able to be solved by a lubricating oil composition includes: a specific low viscosity lubricating base oil that is a blend of specific mineral base oils or further a specific synthetic lubricating base oil; a specific extreme pressure additive; and a specific metallic detergents.

That is, the present invention relates to a gear oil composition comprising: a base oil comprising: a blend of (A) a mineral lubricating base oil having a 100° C. kinematic viscosity of 2 to 6 $mm^2/s$, a % CA of 0.5 or less and a tertiary carbon content of 7% or more and (B) a solvent-refined mineral lubricating base oil having a 100° C. kinematic viscosity of 10 to 70 $mm^2/s$ in an amount of 2 to 40 percent by mass on the total base oil composition mass basis; (D) zinc dialkyldithiophosphate in an amount of 0.02 to 0.5 percent by mass on the zinc amount basis; and (E) an alkaline earth metal detergent having a base number of 100 mgKOH/g or greater in an amount of 0.1 to 0.5 percent by mass on the metal amount basis, on the total gear oil composition mass basis.

Advantageous Effects of Invention

The gear oil composition of the present invention can decrease sufficiently friction under mixed lubricating conditions and also the stir resistance against gears, a shifting clutch, a torque converter and an oil pump and thus can be expected not only to be contribute to an improvement in fuel efficiency attributed by transmissions or final reduction gears but also to be a composition which provides excellent fatigue life for bearings and extreme pressure properties for gears.

The gear oil composition of the present invention is, therefore, a novel fuel saving type transmission lubricating oil composition.

DESCRIPTION OF EMBODIMENT

The present invention will be described in more detail below.

The lubricating base oil of the gear oil composition of the present invention comprises at least (A) a mineral lubricating base oil having a 100° C. kinematic viscosity of 2 to 6 $mm^2/s$, a % CA of 0.5 or less, and a tertiary carbon content of 7% or more (hereinafter referred to as Component (A)) and (B) a solvent-refined mineral lubricating base oil having a 100° C. kinematic viscosity of 10 to 70 $mm^2/s$ (hereinafter referred to as Component (B)). Preferably, the base oil further comprises an ester-based base oil having a 100° C. kinematic viscosity of 2 to 10 $mm^2/s$ (hereinafter referred to as Component (C)).

Component (A) has a 100° C. kinematic viscosity of necessarily 2 $mm^2/s$ or higher, preferably 2.5 $mm^2/s$ or higher, more preferably 3 $mm^2/s$ or higher. Component (A) also has a 100° C. kinematic viscosity of necessarily 6 $mm^2/s$ or lower, preferably 5 $mm^2/s$ or lower, more preferably 4.5 $mm^2/s$ or lower, more preferably 4 $mm^2/s$ or lower. Component (A) with a 100° C. kinematic viscosity of lower than 2 $mm^2/s$ is not preferable because it causes a significant reduction in extreme pressure properties or bearing fatigue life and thus leads to a decreased reliability on the devices. Meanwhile, Component (A) with a 100° C. kinematic viscosity of higher than 6 $mm^2/s$ is also not preferable because the resulting composition would be increased in viscosity and thus would be poor in energy saving performance.

Component (A) has a % CA of necessarily 0.5 or less, preferably 0.3 or less, more preferably 0.2 or less, particularly preferably 0.1 or less. The use of Component (A) having a % CA of 0.5 or less as the base oil results in a composition with an excellent oxidation stability.

The % CA used herein denotes the percentage of the aromatic carbon number in the total carbon number, determined by a method (n-d-M ring analysis) in accordance with ASTM D 3238-85.

Component (A) has a tertiary carbon content of necessarily 7% or more. The term "tertiary carbon content" used herein refers to the percentage of the tertiary carbon in the total amount of the carbon constituting Component (A) and the percentage of the total integral intensity of signals attributed to the carbon atoms of tertiary carbon (>CH—) to the total integral intensity of the all carbons, measured by $^{13}C$-NMR.

In the present invention, the $^{13}C$-NMR measurement was carried out using a sample wherein 0.5 g of the base oil was diluted with 3 g of deuterated chloroform at room temperature and a resonant frequency of 100 MHz. A gated coupling process was used for the measurement. However, other methods may be used if the equivalent results can be obtained. In the present invention, the percentage of the tertiary carbon in the all carbons constituting Component (A) is preferably from 7.0 to 11.0%, more preferably from 7.5 to 10.0%. The percentage of the tertiary carbon set within the above-described range results in a lubricating base oil which is excellent in viscosity temperature characteristics and thermal and oxidation stability.

No particular limitation is imposed on the mineral lubricating base oil used as Component (A) if it has a 100° C. kinematic viscosity, a % CA and a tertiary carbon content, all meeting the above-described requirements. However, it is preferably a hydrocracked mineral base oil. Alternatively, the mineral base oil is preferably a wax-isomerized isoparaffin base oil, which is produced by isomerizing a raw material oil containing 50 percent by mass or more of wax such as a petroleum-based wax or Fischer-Tropsch synthetic oil. Although these base oils may be used alone or in combination, a sole use of a wax-isomerized base oil is preferable. The wax-isomerized base oil has a % CA of substantially 0.

No particular limitation is imposed on the viscosity index of Component (A), which is, however, preferably 90 or greater, more preferably 110 or greater, particularly preferably 120 or greater and usually 200 or less, preferably 160 or less. A viscosity index of 90 or greater would render it possible to produce a composition exhibiting excellent viscosity characteristics from low temperature to high temperature. On the contrast, a too great viscosity index is less effective on fatigue life.

No particular limitation is imposed on the sulfur content of Component (A), which is, however, preferably 0.05 percent by mass or less, more preferably 0.02 percent by mass or less, particularly preferably 0.005 percent by mass or less. Decrease of the sulfur content of Component (A) leads to production of a composition with more excellent oxidation stability.

The content of Component (A) of the base oil is preferably 40 percent by mass or more, more preferably 50 percent by mass or more, more preferably 55 percent by mass or more, particularly preferably 60 percent by mass or more and preferably 90 percent by mass or less, more preferably 80 percent by mass or less, more preferably 70 percent by mass or less, on the total base oil composition mass basis.

The content of Component (A) of the base oil can be properly determined, considering the balance with Component (B) and Component (C) described later so as to exhibit fatigue life and low temperature viscosity characteristics in a most excellent state.

Component (B) of the lubricating oil composition for gears of the present invention is a solvent-refined mineral lubricating oil having a 100° C. kinematic viscosity of 10 to 70 $mm^2/s$. The 100° C. kinematic viscosity is 10 $mm^2/s$ or higher, preferably 20 $mm^2/s$ or higher, more preferably 30 $mm^2/s$ or higher. It is also 70 $mm^2/s$ or lower, preferably 60 $mm^2/s$ or lower, more preferably 55 $mm^2/s$ or lower.

Examples of Component (B) which is a solvent-refined mineral lubricating oil include lubricating oils that are produced by subjecting lubricating oil fractions resulting from atmospheric and vacuum distillations of paraffinic or naphthenic crude oils to a solvent-refining process such as solvent deasphalting, solvent extraction, or solvent dewaxing. Alternatively, in addition to solvent refining, refining processes such as hydrorefining, sulfuric acid treatment, and clay treatment may be used in any combination.

No particular limitation is imposed on the sulfur content of Component (B) lubricating base oil, which is, however, preferably 0.1 percent by mass or more, more preferably 0.3 percent by mass or more, particularly preferably 0.5 percent by mass or more. The sulfur content is also preferably 1.0 percent by mass or less, more preferably 0.8 percent by mass or less, particularly preferably 0.7 percent by mass or less. This is because Component (B) with a too less sulfur content is less effective on fatigue life while Component (B) with a too much sulfur content adversely affects the oxidation stability of the resulting gear oil composition.

The content of Component (B) of the base oil is 2 percent by mass or more, preferably 5 percent by mass or more, more preferably 10 percent by mass or more, more preferably 15 percent by mass or more on the total base oil composition mass. The content is 40 percent by mass or less, preferably 35 percent by mass or less, more preferably 30 percent by mass or less. The content of Component (B) is significantly effective on the fatigue life characteristics of a gear oil composition and thus is importantly the above-described content. The content of Component (B) is determined, preferably considering the balance thereof with Component (A) and Component (C) described below so as to provide a gear oil composition with most excellent low temperature viscosity characteristics and oxidation stability.

The base oil in the lubricating oil composition for gears of the present invention further comprises preferably an ester-based base oil having a 100° C. kinematic viscosity of 2 to 10 $mm^2/s$ in addition to the above-described Components (A) and (B).

The ester referred herein is an organic acid ester. Specific examples include the following esters of monohydric or polyhydric alcohols and monobasic or polybasic acids:

(a) an ester of a monohydric alcohol and a monobasic acid;

(b) an ester of a polyhydric alcohol and a monobasic acid;

(c) an ester of a monohydric alcohol and a polybasic acid;

(d) an ester of a polyhydric alcohol and a polybasic acid;

(e) a mixed ester of a mixture of a monohydric alcohol and a polyhydric alcohol and a polybasic acid;

(f) a mixed ester of a polyhydric alcohol and a mixture of a monobasic acid and a polybasic acid; and (g) a mixed ester of a mixture of a monohydric alcohol and a polyhydric alcohol and a mixture of a monobasic acid and a polybasic acid.

Examples of the monohydric or polyhydric alcohols include those having a hydrocarbon group with 1 to 30, preferably 4 to 20, more preferably 6 to 18 carbon atoms.

Examples of the monobasic or polybasic acids include those having hydrocarbon group with 1 to 30, preferably 4 to 20, more preferably 6 to 18 carbon atoms.

Examples of the hydrocarbon group with 1 to 30 carbon atoms include hydrocarbon groups such as alkyl, alkenyl, cycloalkyl, alkylcycloalkyl, aryl, alkylaryl, and arylalkyl groups.

Examples of the alkyl group include those having 1 to 30 carbon atoms, preferably those having 4 to 20 carbon atoms, particularly preferably those having 6 to 18 carbon atoms, such as methyl, ethyl, n-propyl, isopropyl, n-butyl, isobutyl, sec-butyl, tert-butyl, straight-chain or branched pentyl, straight-chain or branched hexyl, straight-chain or branched heptyl, straight-chain or branched octyl, straight-chain or branched nonyl, straight-chain or branched decyl, straight-chain or branched undecyl, straight-chain or branched dodecyl, straight-chain or branched tridecyl, straight-chain or branched tetradecyl, straight-chain or branched pentadecyl, straight-chain or branched hexadecyl, straight-chain or branched heptadecyl, straight-chain or branched octadecyl, straight-chain or branched nonadecyl, straight-chain or branched eicosyl, straight-chain or branched heneicosyl, straight-chain or branched docosyl, straight-chain or branched tricosyl, and straight-chain or branched tetracosyl groups.

Examples of the alkenyl groups include those having 2 to 30 carbon atoms, preferably those having 4 to 20 carbon atoms, particularly preferably those having 6 to 18 carbon atoms, such as vinyl, straight-chain or branched propenyl, straight-chain or branched butenyl, straight-chain or branched pentenyl, straight-chain or branched hexenyl, straight-chain or branched heptenyl, straight-chain or branched octenyl, straight-chain or branched nonenyl, straight-chain or branched decenyl, straight-chain or branched undecenyl, straight-chain or branched dodecenyl, straight-chain or branched tridecenyl, straight-chain or branched tetradecenyl, straight-chain or branched pentadecenyl, straight-chain or branched hexadecenyl, straight-chain or branched heptadecenyl, straight-chain or branched octadecenyl, straight-chain or branched nonadecenyl, straight-chain or branched eicosenyl, straight-chain or branched heneicosenyl, straight-chain or branched docosenyl, straight-chain or branched tricosenyl and straight-chain or branched tetracosenyl groups.

Specific examples of the monohydric alcohol include monohydric alkyl alcohols having 1 to 30 carbon atoms (the alkyl groups may be straight-chain or branched) such as methanol, ethanol, propanol (1-propanol, 2-propanol), butanol (1-butanol, 2-butanol, 2-methyl-1-propanol, 2-methyl-2-propanol), pentanol (1-pentanol, 2-pentanol, 3-pentanol, 2-methyl-1-butanol, 3-methyl-1-butanol, 3-methyl-2-butanol, 2-methyl-2-butanol, 2,2-dimethyl-1-propanol), hexanol (1-hexanol, 2-hexanol, 3-hexanol, 2-methyl-1-pentanol, 2-methyl-2-pentanol, 2-methyl-3-pentanol, 3-methyl-1-pentanol, 3-methyl-2-pentanol, 3-methyl-3-pentanol, 4-methyl-1-pentanol, 4-methyl-2-pentanol, 2,3-dimethyl-1-butanol, 2,3-dimethyl-2-butanol, 3,3-dimethyl-1-butanol, 3,3-dimethyl-2-butanol, 2-ethyl-1-butanol, 2,2-dimethylbutanol), heptanol (1-heptanol, 2-heptanol, 3-heptanol, 2-methyl-1-hexanol, 2-methyl-2-hexanol, 2-methyl-3-hexanol, 5-methyl-2-hexanol, 3-ethyl-3-pentanol, 2,2-dimethyl-3-pentanol, 2,3-dimethyl-3-pentanol, 2,4-dimethyl-3-pentanol, 4,4-dimethyl-2-pentanol, 3-methyl-1-hexanol, 4-methyl-1-hexanol, 5-methyl-1-hexanol, 2-ethylpentanol), octanol (1-octanol, 2-octanol, 3-octanol, 4-methyl-3-heptanol, 6-methyl-2-heptanol, 2-ethyl-1-hexanol, 2-propyl-1-pentanol, 2,4,4-trimethyl-1-pentanol, 3,5-dimethyl-1-hexanol, 2-methyl-1-heptanol, 2,2-dimethyl-1-hexanol), nonanol (1-nonanol, 2-nonanol, 3,5,5-trimethyl-1-hexanol, 2,6-dimethyl-4-heptanol, 3-ethyl-2,2-dimethyl-3-pentanol, 5-methyloctanol), decanol (1-decanol, 2-decanol, 4-decanol, 3,7-dimethyl-1-octanol, 2,4,6-trimethylheptanol), undecanol, dodecanol, tridecanol, tetradecanol, pentadecanol, hexadecanol, heptadecanol, and octadecanol (stearyl alcohol), nonadecanol, eicosanol, heneicosanol, tricosanol and tetracosanol; monohydric alkenyl alcohols having 2 to 40 carbon atoms (the alkenyl groups may be straight-chain or branched and the position of the double bond may vary) such as ethenol, propenol, butenol, hexenol, octenol, decenol, dodecenol, and octadecenol (oleyl alcohol); and mixtures thereof.

Specific examples of the polyhydric alcohols include dihyrdic alkyl or alkenyl diols having 2 to 30 carbon atoms (the alkyl or alkenyl groups may be straight-chain or branched, and the positions of the double bond and hydroxyl group of the alkenyl groups may vary) such as ethylene glycol, diethylene glycol, polyethylene glycol, propylene glycol, dipropylene glycol, polypropylene glycol, neopentyl glycol, 1,3-propanediol, 1,4-butanediol, 1,2-butanediol, 2-methyl-1,3-propanediol, 1,5-pentanediol, 1,6-hexanediol, 2-ethyl-2-methyl-1,3-propanediol, 2-methyl-2,4-pentanediol, 1,7-heptanediol, 2-methyl-2-propyl-1,3-propanediol, 2,2-diethyl-1,3-propanediol, 1,8-octanediol, 1,9-nonanediol, 2-butyl-2-ethyl-1,3-propanediol, 1,10-decanediol, 1,11-undecanediol, 1,12-dodecanediol, 1,13-tridecanediol, 1,14-tetradecanediol, 1,15-heptadecanediol, 1,16-hexadecanediol, 1,17-heptadecanediol, 1,18-octadecanediol, 1,19-nonadecanediol, 1,20-eicosadecanediol; glycerin, trimethylolalkanes such as trimethylolethane, trimethylolpropane, and trimethylolbutane, erythritol, pentaerythritol, 1,2,4-butanetriol, 1,3,5-pentanetriol, 1,2,6-hexanetriol, 1,2,3,4-butanetetrol, sorbitol, adonitol, arabitol, xylytol, and mannitol, and polymers or condensated products thereof (for example, dimers through octamers of glycerine, such as diglycerin, triglycerine, and tetraglycerin, dimers through octamers of trimethylolpropane such as ditrimethylolpropane, dimers through tetramers of pentaerythritol such as dipentaerythritol, sorbitan, condensation compounds such as sorbitol glycerin condensation products (intermolecular condensation compounds, intramolecular condensation compounds or self-condensation compounds).

Alternatively, the above-described alcohols may be those produced by adding thereto an alkylene oxide having 2 to 6, preferably 2 to 4 carbon atoms or a polymer or copolymer thereof and then hydrocarbyl-etherifying or hydrocarbyl-esterifying the hydroxyl groups of the alcohols. Examples of the alkylene oxide having 2 to 6 carbon atoms include ethylene oxide, propylene oxide, 1,2-epoxybutane (n-butylene oxide), 2,3-epoxybutane (β-butylene oxide), 1,2-epoxy-1-methylpropane, 1,2-epoxyheptane, and 1,2-epoxyhexane. Among these alkylene oxides, preferred are ethylene oxide, propylene oxide, and butylene oxide, and more preferred are ethylene oxide and propylene oxide because of their excellent low friction properties. In the case of using two or more types of alkylene oxides, no particular limitation is imposed on the polymerization mode of the oxyalkylene groups, which may be random- or block-copolymerization. When an alkylene oxide is added to a polyhydric alcohol having 2 to 6 hydroxyl groups, it may be added to all or part of the hydroxyl groups.

Examples of the above-described monobasic acid include saturated aliphatic monocarboxylic acids having 1 to 30 carbon atoms (the saturated aliphatic groups may be straight-chain or branched), such as methanoic acid, ethanoic acid (acetic acid), propanoic acid (propionic acid), butanoic acid (butyric acid, isobutyric acid), pentanoic acid (valeric acid, isovaleric acid, pivalic acid), hexanoic acid (caproic acid), heptanoic acid, octanoic acid (caprylic acid), nonanoic acid (pelargonic acid), decanoic acid, undecanoic acid, dodecanoic acid (lauric acid), tridecanoic acid, tetradecanoic acid (myristic acid), pentadecanoic acid, hexadecanoic acid (palmitic acid), heptadecanoic acid, octadecanoic acid (stearic acid), nonadecanoic acid, eicosanoic acid, heneicosanoic acid, docosanoic acid, tricosanoic acid, tetracosanoicacid, pentacosanoic acid, hexacosanoic acid, heptacosenoic acid, octacosanoic acid, nonacosanoic acid, and triacontanoic acid; and unsaturated aliphatic monocarboxylic acids having 1 to 30 carbon atoms (the unsaturated aliphatic groups may be straight-chain or branched and the position of the unsaturated bonds may vary), such as propenoic acid (acrylic acid), propionic acid (propiolic acid), butenoic acid (methacrylic acid, crotonic acid, isocrotonic acid), pentenoic acid, hexenoic acid, heptenoic acid, octenoic acid, nonenoic acid, decenoic acid, undecenoic acid, dodecenoic acid, tridecenoic acid, tetradecenoic acid, pentadecenoic acid, hexadecenoic acid, heptadecenoic acid, octadecenoic acid (oleic acid), nonadecenoic acid, eicosenoic acid, heneicosenoic acid, docosenoic acid, tricosenoic acid, tetracosenoic acid, pentacosenoic acid, hexacosenoic acid, heptacosenoic acid, octacosenoic acid, nonacosenoic acid, and triacontenoic acid.

Examples of the above-described polybasic acid include saturated or unsaturated aliphatic dicarboxylic acids (the saturated or unsaturated aliphatic groups may be straight-chain or branched and the position of the unsaturated bonds may vary) such as ethanedioic acid (oxalic acid), propanedioic acid (malonic acid), butanedioic acid (succinic acid, methylmalonic acid), pentanedioic acid (glutaric acid, ethylmalonic acid), hexanedioic acid (adipic acid), heptanedioic acid (pimelic acid), octanedioic acid (suberic acid), nonanedioic acid (azelaic acid), decanedioic acid (sebacylic acid), propenedioic acid, butenedioic acid (maleic acid, fumaric acid), pentenedioic acid (citraconic acid, mesaconic acid), hexenedioic acid, heptenedioic acid, octenedioic acid, nonanedioic acid, and decenedioic acid; saturated or unsaturated aliphatic tricarboxylic acids (the saturated or unsaturated aliphatic groups may be straight-chain or branched and the position of the unsaturated bonds may vary) such as propanetricarboxylic acid, butanetricarboxylic acid, pentanetricarboxylic acid, hexanetricarboxylic acid, heptanetricarboxylic acid, octanetricarboxylic acid, nonanetricarboxylic acid, decanetricarboxylic acid; and saturated or unsaturated aliphatic tetracarboxylic acids (the saturated or unsaturated aliphatic group may be straight-chain or branched and the position of the unsaturated bonds may vary).

Component (C) that is an ester-based base oil used in the present invention may be any one of or a mixture of two or more types of ester-based base oils satisfying the above-described requirements or alternatively may be a mixture of one or more of ester-based base oils satisfying the above-described requirements and an ester-based base oil not satisfying the above-described requirements if the resulting mixture satisfies the above-described requirements.

Component (C) that is an ester-based base oil used in the present is preferably a polyhydric alcohol ester-based base oil, most preferably is selected from esters of saturated or unsaturated monovalent fatty acids having 6 to 18, preferably 12 to 18 carbon atoms (these fatty acids may be straight-chain or branched and the position of the double bonds may vary) and polyhydric aliphatic alcohols.

Component (C) has a 100° C. kinematic viscosity of preferably 2 to 10 $mm^2/s$, more preferably 3 to 8 $mm^2/s$. Blending of an ester-based base oil having a 100° C. kinematic viscosity of 2 to 10 $mm^2/s$ improves significantly the fatigue lives of bearings and gears.

Preferably, other than Component (C), the lubricating base oil does not contain a base oil having a 100° C. kinematic viscosity of higher than 6 $mm^2/s$ and less than 10 $mm^2/s$. This is because such a base oil tends to shorten the fatigue life of gears or the like.

No particular limitation is imposed on the pour point of Component (C) that is an ester-based base oil, which is, however, preferably −20° C. or lower, more preferably −30° C. or lower, particularly preferably −40° C. or lower. The use of Component (C) with a pour point of −20° C. or lower can provide the resulting composition with excellent low friction characteristics at low temperature ranges, startability and fuel saving performance right after starting.

No particular limitation is imposed on the content of Component (C) that is an ester-based base oil in the present invention, which is, however, preferably 5 percent by mass or more, more preferably 7 percent by mass or more, more preferably 10 percent by mass or more on the basis of the total mass of the base oil. The content of Component (C) is also preferably 20 percent by mass or less, more preferably 15 percent by mass or less in view of the swelling characteristics of a seal material.

The lubricating base oil of the lubricating oil composition for gears according to the present invention is preferably a lubricating base oil adjusted to have a 100° C. kinematic viscosity of 3 $mm^2/s$ or higher, preferably 4 $mm^2/s$ or higher, more preferably 5 $mm^2/s$ or higher and 8 $mm^2/s$ or lower, preferably 7 $mm^2/s$ or lower, more preferably 6.5 $mm^2/s$ or lower.

The viscosity of the base oil gives a significant influence on fatigue life, and since a base oil with a higher viscosity basically prolong fatigue life but would be deteriorated in low temperature viscosity, an appropriate viscosity range exists.

The lubricating oil composition for gears of the present invention comprises indispensably (D) zinc dialkyldithiophosphate (hereinafter referred to as Component (D)).

Examples of zinc dialkyldithiophosphate include those represented by formula (1) below.

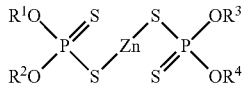

(1)

In formula (1), $R^1$, $R^2$, $R^3$ and $R^4$ are each independently a hydrocarbon group having 1 to 18 carbon atoms, examples of which include alkyl groups having 1 to 18 carbon atoms such as methyl, ethyl, n-propyl, isopropyl, n-butyl, isobutyl, sec-butyl, tert-butyl, straight-chain or branched pentyl, straight-chain or branched hexyl, straight-chain or branched heptyl, straight-chain or branched octyl, straight-chain or branched nonyl, straight-chain or branched decyl, straight-chain or branched undecyl, straight-chain or branched dodecyl, straight-chain or branched tridecyl, straight-chain or branched tetradecyl, straight-chain or branched pentadecyl, straight-chain or branched hexadecyl, straight-chain or branched heptadecyl, and straight-chain or branched octadecyl groups.

Specific particularly preferable examples of Component (D) that is zinc dialkyldithiophosphate include zinc diisopropyldithiophosphate, zinc diisobutyldithiophosphate, zinc di-sec-butyldithiophosphate, zinc di-sec-pentyldithiophosphate, zinc di-n-hexyldithiophosphate, zinc di-sec-hexyldithiophosphate, zinc di-n-octyldithiophosphate, zinc di-2-ethylhexyldithiophosphate, zinc di-n-decyldithiophosphate, zinc di-n-dodecyldithiophosphate, zinc diisotridecyldithiophosphate, and mixtures thereof. Among these compounds, preferred are zinc di-sec-alkyldithiophosphates such as zinc di-sec-butyldithiophosphate, zinc di-sec-pentyldithiophosphate, and zinc di-sec-hexyldithiophosphate.

The lower limit content of Component (D) of the gear oil composition of the present invention is 0.02 percent by mass or more, preferably 0.1 percent by mass or more while the upper limit is 0.5 percent by mass or less, preferably 0.3 percent by mass or less, on the zinc amount basis on the total lubricating oil composition mass basis. A Component (D) content of less than 0.02 percent by mass is not preferable because it would be less effective in prolonging the life or fail to exhibit sufficient antiwear properties while a Component (D) content of more than 0.5 percent by mass is not also preferable because it adversely affects the oxidation stability of the resulting composition.

The lubricating oil composition for gears of the present invention comprises indispensably (E) an alkaline earth metal detergent having a base number of 100 mgKOH/g or larger (hereinafter referred to as Component (E)). Examples of such an alkaline earth metal detergent include alkaline earth metal sulfonates, alkaline earth metal phenates, alkaline earth metal salicylates, alkaline earth metal phosphonates, and mixtures thereof.

The alkaline earth metal sulfonate is more specifically and preferably an alkaline earth metal salt, in particular magnesium salt and/or calcium salts, of an alkyl aromatic sulfonic acid produced by sulfonating an alkyl aromatic compound having a molecular weight of 100 to 1500, preferably 200 to 700. Specific examples of the alkyl aromatic sulfonic acid include petroleum sulfonic acids and synthetic sulfonic acids.

The petroleum sulfonic acids may be those produced by sulfonating an alkyl aromatic compound contained in the lubricant fraction of a mineral oil or may be mahogany acid by-produced upon production of white oil. The synthetic sulfonic acids may be those produced by sulfonating an alkyl benzene having a straight-chain or branched alkyl group, produced as a by-product from a plant for producing an alkyl benzene used as the raw material of a detergent or produced by alkylating polyolefin to benzene, or those produced by sulfonating alkylnaphthalenes such as dinonylnaphthalene. No particular limitation is imposed on the sulfonating agent used for sulfonating these alkyl aromatic compounds. In general, fuming sulfuric acids or sulfuric acid may be used.

The alkaline earth metal phenate is more specifically and preferably an alkaline earth metal salt, in particular magnesium salt and/or calcium salt, of an alkylphenol having at least one straight-chain or branched alkyl group having 4 to 30, preferably 6 to 18 carbon atoms, an alkylphenolsulfide produced by reacting the alkylphenol with sulfur or a Mannich reaction product of an alkylphenol produced by reacting the alkylphenol with formaldehyde.

The alkaline earth metal salicylate is more specifically and preferably an alkaline earth metal salt, in particular magnesium salt and/or calcium salt, of alkylsalicylic acid having at least one straight-chain or branched alkyl group having 4 to 30, preferably 6 to 18 carbon atoms.

The alkaline earth metal sulfonates, alkaline earth metal phenates, and alkaline earth metal salicylates include neutral salts (normal salts) produced by reacting alkyl aromatic sulfonic acids, alkylphenols, alkylphenolsulfides, Mannich reaction products of alkylphenols or alkylsalicylic acids directly with a metallic base such as an alkaline earth metal oxide or hydroxide or produced by converting alkyl aromatic sulfonic acids, alkylphenols, alkylphenolsulfides, Mannich reaction products of alkylphenols or alkylsalicylic acids to alkali metal salts such as sodium salts and potassium salts, followed by substitution with an alkaline earth metal salt; basic salts produced by heating these neutral salts (normal salts) with an excess amount of an alkaline earth metal salt or an alkaline earth metal base (alkaline earth metal hydroxide or oxide) in the presence of water; and overbased salts (ultrabasic salts) produced by reacting these neutral salts with a base such as an alkali metal or alkaline earth metal hydroxide in the presence of carbonic acid gas, or boric acid or boric acid salt. These reactions are generally carried out in a solvent (aliphatic hydrocarbon solvents such as hexane, aromatic hydrocarbon solvents such as xylene, and light lubricating base oil).

Preferred for Component (E) of the gear oil composition of the present invention are alkaline earth metal sulfonates and alkaline earth metal phenates. Most preferred are alkaline earth metal sulfonates. This is because among these Components (E) that are metallic detergents, sulfonates are most excellent in antiwear properties, followed by phenates.

Furthermore, as Component (E) of the gear oil composition of the present invention, an overbased metallic detergent containing an excess metal salt such as carbon salt is more preferable to the neutral salt detergents. Specifically, Component (E) is preferably a metallic detergent which has a metal ratio of 2.5 or larger, which metal ratio is a value obtained by dividing the mole number of an alkaline earth metal multiplied by the valence of 2, by the mole number of the soap group of the metallic detergent.

In the present invention, one or more metallic detergents selected from alkaline earth metal sulfonates, phenates and salicylates may be used.

The total base number of Component (E) that is an alkaline earth metal detergent of the gear oil composition of the present invention is necessarily 100 mgKOH/g or greater, preferably 140 mgKOH/g or greater, more preferably 200 mgKOH/g or greater. The total base number is preferably 500 mgKOH/g or less, more preferably 450 mgKOH/g or less, more preferably 400 mgKOH/g or less. If the base number is less than 100 mgKOH/g, the resulting lubricating oil composition would be less effective in extending the fatigue life. If the base number is greater than 500 mgKOH/g, the resulting lubricating oil composition would lack stability. The term "total base number" used herein denotes one measured by the perchloric acid potentiometric titration method in accordance with section 7 of JIS K2501 "Petroleum products and lubricants-Determination of neutralization number".

In the present invention, no particular limitation is imposed on the content of Component (E), which is, however, usually preferably 0.5 percent by mass or less on the metal basis on the total composition mass basis and is adjusted with other additives such that the sulfated ash content is 1.2 percent by mass or less. In view of this, the upper limit content of the metallic detergent is more preferably 0.3 percent by mass or less, more preferably 0.25 percent by mass or less, particularly preferably 0.2 percent by mass or less on the metal basis on the total composition mass basis. No particular limitation is imposed on the lower limit content, which is, however, preferably 0.01 percent by mass or more, more preferably 0.02 percent by mass or more, particularly preferably 0.05 percent by mass or more.

Although metallic detergents are usually commercially available as diluted with a light lubricating base oil, it is preferable to use a metallic detergent whose metal content is from 1.0 to 20 percent by mass, preferably from 2.0 to 16 percent by mass.

Preferably, the lubricating oil composition for gears of the present invention contains (F) a poly(meth)acrylate-based viscosity index improver (hereinafter referred to as Component (F)). The poly(meth)acrylate-based viscosity index improver is preferably a poly(meth)acrylate substantially containing a structural unit derived from a monomer represented by formula (2) below.

(2)

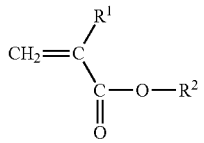

In formula (2), $R^1$ is hydrogen or methyl, preferably methyl, and $R^2$ is a hydrocarbon group having 1 to 30 carbon atoms. However, the poly (meth)acrylate contains necessarily in its structural unit at least a structural unit wherein $R^2$ is a hydrocarbon group of 20 or more carbon atoms.

Specific examples of the hydrocarbon group having 1 to 30 carbon atoms include alkyl groups having 1 to 30 carbon atoms, such as methyl, ethyl, n-propyl, isopropyl, n-butyl, isobutyl, sec-butyl, tert-butyl, straight-chain or branched pentyl, straight-chain or branched hexyl, straight-chain or branched heptyl, straight-chain or branched octyl, straight-chain or branched nonyl, straight-chain or branched decyl, straight-chain or branched undecyl, straight-chain or branched dodecyl, straight-chain or branched tridecyl, straight-chain or branched tetradecyl, straight-chain or branched pentadecyl, straight-chain or branched hexadecyl, straight-chain or branched heptadecyl, straight-chain or branched octadecyl, straight-chain or branched nonadecyl, straight-chain or branched eicosyl, straight-chain or branched heneicosyl, straight-chain or branched docosyl, straight-chain or branched tricosyl, straight-chain or branched tetracosyl groups.

Component (F) used in the present invention may contain a structural unit derived from a monomer represented by formula (3) or (4) below.

(3)

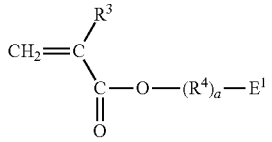

In formula (3) above, $R^3$ is hydrogen or methyl, $R^4$ is an alkylene group having 1 to 30 carbon atoms, $E^1$ is an amine residue or heterocyclic residue having 1 or 2 nitrogen atoms and 0 to 2 oxygen atoms, and a is an integer of 0 or 1.

(4)

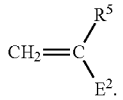

In formula (4), $R^5$ is hydrogen or methyl, and $E^2$ is an amine residue or heterocyclic residue having 1 or 2 nitrogen atoms and 0 to 2 oxygen atoms.

Specific examples of the amine residue or heterocyclic residue represented by $E^1$ and $E^2$ in formulas (3) and (4) include dimethylamino, diethylamino, dipropylamino, dibutylamino, anilino, toluidino, xylidino, acetylamino, benzoilamino, morpholino, pyrrolyl, pyrrolino, pyridyl, methylpyridyl, pyrrolidinyl, piperidinyl, quinonyl, pyrrolidonyl, pyrrolidono, imidazolino and pyrazino groups.

Preferable examples for $E^1$ and $E^2$ include dimethylaminomethyl methacrylate, diethylaminomethyl methacrylate, dimethylaminoethyl methacrylate, diethylaminoethyl methacrylate, 2-methyl-5-vinyl pyridine, morpholinomethyl methacrylate, morpholinoethyl methacrylate, N-vinyl pyrrolidone and mixtures thereof.

Specific examples of the poly(meth)acrylate-based viscosity index improver for Component (F) include poly(meth) acrylates produced by polyermerizing (meth)acrylates selected from the following (Fa) to (Fd) represented by formula (2) in the following blend ratio and copolymers of such (meth)acrylates with (Fe) polar group-containing monomers represented by formula (3) and/or (4):

(Fa) (meth)acrylates having an alkyl group of 1 to 4 carbon atoms;

(Fb) (meth)acrylate having an alkyl group of 5 to 10 carbon atoms;

(Fc) (meth)acrylates having an alkyl group of 12 to 18-carbon atoms;

(Fd) (meth)acrylate having an alkyl group of 20 or more carbon atoms; and (Fe) polar group-containing monomers.

The structural ratio of monomers (Fa) to (Fe) are preferably as follows on the total monomer mass basis:

Component (Fa): preferably 10 to 60 mole %, more preferably 20 to 50 mole %,

Component (Fb): preferably 0 to 50 mole %, more preferably 0 to 20 mole %,

Component (Fc): preferably 10 to 60 mole %, more preferably 20 to 40 mole %,

Component (Fd): preferably 1 to 20 mole %, more preferably 5 to 10 mole %,

Component (Fe): preferably 0 to 20 mole %, more preferably 0 to 10 mole %, particularly preferably 0 to 5 mole %.

Blending of a poly(meth)acrylate-based viscosity index improver with this formulation can improve the low temperature viscosity characteristics and ability of extending fatigue life of a lubricating oil composition at the same time.

No particular limitation is imposed on the weight average molecular weight of Component (F) used in the present invention, which is, however, usually from 5,000 to 150,000 but preferably from 10,000 to 60,000, more preferably from 15,000 to 30,000, particularly preferably from 15,000 to 24,000 because it can provide more excellent fatigue life.

The weight-average molecular weight used herein denotes a weight-average molecular weight on polystyrene basis determined with a differential refractive index detector (RI) at a temperature of 23° C., a flow rate of 1 mL/min, a sample concentration of 1 percent by mass, and a sample injection amount of 75 μL, using 150-C ALC/GPC manufactured by Waters having two columns GMHHR-M (7.8 mm Idx30 cm) equipped in series therein and tetrahydrofuran as a solvent.

No particular limitation is imposed on the method for producing the above-described poly(meth)acrylate. For example, it can be easily produced by radical-solution polymerization of a mixture of monomers (Fa) to (Fe) that can form the intended poly(meth)acrylate in the presence of a polymerization initiator such as benzoyl peroxide.

In addition to Component (F) that is the above-described poly(meth)acrylate, the lubricating oil composition of the present invention may further contain other viscosity index improvers such as non-dispersant or dispersant type ethylene-α-olefin copolymers and hydrogenated compounds thereof, polyisobutylene and hydrogenated compounds thereof, styrene-diene hydrogenated copolymers, styrene-maleic anhydride ester copolymers, polyalkylstyrenes and copolymers of (meth)acrylate monomers represented by formula (2) and unsaturated monomers such as ethylene/propylene/styrene/maleic anhydride.

The content of Component (F) that is a poly(meth)acrylate-based additive of the lubricating oil composition present invention is such an amount that the 100° C. kinematic viscosity of the lubricating oil composition is from 3 to 8 $mm^2/s$, preferably from 4.5 to 6 $mm^2/s$, and the viscosity index is from 95 to 200, preferably from 120 to 190, more preferably from 150 to 180. More specifically, the content is preferably from 0.1 to 15 percent by mass, more preferably from 2 to 12 percent by mass, particularly preferably from 3 to 8 percent by mass on the basis of the total mass of the lubricating oil composition. If Component (F) is contained in an amount of less than 0.1 percent by mass, it would be less effective in enhancing the viscosity index or reducing the product viscosity and thus possibly fail to improve the fuel saving performance. If Component (F) is contained in an amount of more than 15 percent by mass, it would not be expected to improve the fatigue life as balanced with the content and also would be poor in shear stability and thus unlikely to keep the initial extreme pressure properties for a long period of time.

The lubricating oil composition for gears of the present invention contains preferably (G) a sulfurized olefin (hereinafter referred to as Component (G)). Examples of such a sulfurized olefin include compounds represented by formula (5):

$$R^{11}—S_x—R^{12} \quad (5).$$

In formula (5), $R^{11}$ is an alkenyl group having 2 to 15 carbon atoms, $R^{12}$ is an alkyl or alkenyl group having 2 to 15 carbon atoms, and x is an integer of 1 to 8.

The compounds can be produced by reacting an olefin having 2 to 15 carbon atoms or a dimer to tetramer thereof with sulfur or a sulfurizing agent such as sulfur chloride. Such an olefin is preferably propylene, isobutene, or diisobutene.

Examples of another form of the sulfurized olefin include dihydrocarbyl polysulfides. The dihydrocarbyl polysulfide is a compound represented by formula (6):

$$R^{13}-Sy-R^{14} \quad (6)$$

In formula (6), $R^{13}$ and $R^{14}$ are each independently an alkyl(including cycloalkyl) group having 1 to 20 carbon atoms, an aryl group having 6 to 20 carbon atoms, or an arylalkyl group having 7 to 20 carbon atoms and may be the same or different from one another, and y is an integer of 2 to 8.

Specific examples of $R^{13}$ and $R^{14}$ include methyl, ethyl, n-propyl, isopropyl, n-butyl, isobutyl, sec-butyl, tert-butyl, various pentyls, various hexyls, various heptyls, various octyls, various nonyls, various decyls, various dodecyls, cyclohexyl, phenyl, naphthyl, tolyl, xylyl, benzyl, and phenetyl groups.

Preferred examples of the dihydrocarbyl polysulfide include dibenzyl polysulfide, di-tert-nonylpolysulfide, didodecylpolysulfide, di-tert-butylpolysulfide, dioctylpolysulfide, diphenylpolysulfide, and dicyclohexylpolysulfide.

The content of Component (G) that is a sulfurized olefin is preferably 0.1 percent by mass or more, more preferably 0.2 percent by mass or more, more preferably 0.5 percent by mass or more, and preferably 2 percent by mass or less, more preferably 1.5 percent by mass or less on the total lubricating oil composition mass basis. If the content is less than 0.1 percent by mass, an improvement in the anti-seizure properties may not be recognized. If the content is more than 2 percent by mass, it would degrade significantly the oxidation stability of the composition.

The lubricating oil composition of the present invention may further contain any additives that have been generally used depending on their purposes in order to further enhance the properties. Examples of such additives include metallic detergent other than the overbased metal salts exemplified with respect to Component (E), ashless dispersants, antiwear agents (or extreme pressure additives), anti-oxidants, corrosion inhibitors, rust inhibitors, demulsifiers, metal deactivators, and anti-foaming agents.

Examples of the metallic detergents other than the overbased metal salts of Component (E) include normal salts or basic salts of alkali metal/alkaline earth metal sulfonates, alkali metal/alkaline earth metal phenates and alkali metal/alkaline earth metal salicylates. Examples of the alkali metal include sodium and potassium. Examples of the alkaline earth metal include magnesium, calcium and barium. Preferred are magnesium and calcium. Particularly preferred is calcium.

The ashless dispersant may be any ashless dispersant that is usually used for a lubricating oil. Examples of the ashless dispersant include mono- or bis-succinimides having in their molecules at least one straight-chain or branched alkyl or alkenyl group having 40 to 400 carbon atoms, benzylamines having in their molecules at least one alkyl or alkenyl group having 40 to 400 carbon atoms, polyamines having in their molecules at least one alkyl or alkenyl group having 40 to 400 carbon atoms, and boron-, carboxylic acid-, and phosphoric acid-modified products thereof. Any one or more of these ashless dispersants may be blended.

The anti-oxidant may be an ashless anti-oxidant such as a phenol- or amine-based anti-oxidant, or a metallic anti-oxidant such as a copper- or molybdenum-based anti-oxidant. Specific examples include alkylphenols such as 2-6-di-tert-butyl-4-methylphenol; bisphenols such as methylene-4,4-bisphenol(2,6-di-tert-butyl-4-methylphenol); naphthylamines such as phenyl-α-naphthylamine; dialkyldiphenylamines; zinc dialkyldithiophosphoric acids such as di-2-ethylhexyldithiophosphoric acid; and esters of (3,5-di-tert-butyl-4-hydroxyphenyl) fatty acid (propionic acid) or (3-methyl-5-tert-butyl-4-hydroxyphenyl) fatty acid (propionic acid) with a monohydric or polyhydric alcohol such as methanol, octanol, octadecanol, 1,6-hexanediol, neopentyl glycol, thiodiethylene glycol, triethylene glycol and pentaerythritol.

The antiwear agent (or extreme pressure additive) may be any anti-oxidant or extreme pressure additive that has been used for lubricating oil, other than Component (D). For example, sulfuric-, phosphoric- and sulfuric-phosphoric extreme pressure additives may be used. Specific examples include phosphorus acid esters, thiophosphorus acid esters, dithiophosphorus acid esters, trithiophosphorus acid esters, phosphoric acid esters, thiophosphoric acid esters, dithiophosphoric acid esters, trithiophosphoric acid esters, amine salts, metal salts or derivatives thereof, dithiocarbamates, zinc dithiocaramates, molybdenum dithiocarbamates, disulfides, polysulfides, and sulfurized fats and oils.

Examples of the corrosion inhibitor include benzotriazole-, tolyltriazole-, thiadiazole-, and imidazole-types compounds.

Examples of the rust inhibitor include petroleum sulfonates, alkylbenzene sulfonates, dinonylnaphthalene sulfonates, and alkenyl succinic acid esters.

Examples of the demulsifier include polyalkylene glycol-based non-ionic surfactants such as polyoxyethylenealkyl ethers, polyoxyethylenealkylphenyl ethers, and polyoxyethylenealkylnaphthyl ethers.

Examples of the metal deactivator include imidazolines, pyrimidine derivatives, alkylthiadiazoles, mercaptobenzothiazoles, benzotriazoles and derivatives thereof, 1,3,4-thiadiazolepolysulfide, 1,3,4-thiadiazolyl-2,5-bisdialkyldithiocarbamate, 2-(alkyldithio)benzoimidazole, and β-(o-carboxybenzylthio)propionitrile.

Examples of the anti-foaming agent include silicone oil with a 25° C. kinematic viscosity of 1000 to 100,000 $mm^2/s$, alkenylsuccinic acid derivatives, esters of polyhydroxy aliphatic alcohols and long-chain fatty acids, aromatic amine salts of methylsalicylate and o-hydroxybenzyl alcohol.

When these additives are contained in the lubricating oil composition of the present invention, they are each preferably contained in an amount of 0.001 to 10 percent by mass on the total composition mass basis.

The friction modifier may be any one of those for lubricating oils but is preferably an amine compound, an imide compound, a fatty acid ester, a fatty acid amide or a fatty acid metal salt, each having in its molecules an alkyl or alkenyl group having 6 to 30 carbon atoms, particularly a straight-chain alkyl or alkenyl group having 6 to 30 carbon atoms. Examples of the amine compound include straight-chain or branched, preferably straight-chain aliphatic monoamines having 6 to 30 carbon atoms; straight-chain or branched, preferably straight-chain aliphatic polyamines having 6 to 30 carbon atoms; and alkyleneoxide adducts of such aliphatic amines. Examples of the imide compound include succinimides having a straight-chain or branched alkyl or alkenyl group having 6 to 30 carbon atoms and/or modified products thereof with a carboxylic acid, boric acid, phosphoric acid or sulfuric acid. Examples of the fatty acid ester include esters of straight-chain or branched, preferably straight-chain fatty acids having 7 to 31 carbon atoms with aliphatic monohydric alcohols or aliphatic polyhydric alcohols. Examples of the fatty acid amides include amides of straight-chain or branched, preferably straight-chain fatty acids having 7 to 31 carbon atoms with aliphatic monoamines or aliphatic polyamines. Examples of the fatty acid metal salts include alkaline earth metal salts (magnesium salts or calcium salts) or zinc salts of straight-chain or branched, preferably straight-chain fatty acids having 7 to 31 carbon atoms.

In particular, sulfurized fats and oils are preferably used as a friction modifier for manual transmissions. Examples of the sulfurized fats and oils include oils such as sulfurized lard, sulfurized rapeseed oil, sulfurized ricinus oil, sulfurized soybean oil, and sulfurized rice bran oil; disulfurized fatty acids such as sulfurized oleic acid; and sulfurized esters such as sulfurized oleic methyl oleate.

One or more compounds selected from the above-described friction modifiers may be blended in the composition in an arbitrary amount, but is usually blended in an amount of 0.01 to 5.0 percent by mass and preferably 0.03 to 3.0 percent by mass on the total lubricating oil composition mass basis.

The lubricating oil composition of the present invention has a 100° C. kinematic viscosity of preferably 8 $mm^2/s$ or lower, preferably 7.5 $mm^2/s$ or lower, more preferably 7.0 $mm^2/s$ or lower. The lubricating oil composition of the present invention has a 100° C. kinematic viscosity of preferably 3 $mm^2/s$ or higher, more preferably 4 $mm^2/s$ or higher, more preferably 5 $mm^2/s$ or higher. The 100° C. kinematic viscosity used herein refers to the 100° C. kinematic viscosity determined in accordance with ASTM D-445. If the 100° C. kinematic viscosity is lower than 3 $mm^2/s$, the resulting composition would lack lubricity. If the 100° C. kinematic viscosity is higher than 8 $mm^2/s$, the resulting composition would not attain the required low temperature viscosity or a sufficient fuel saving performance.

The lubricating oil composition of the present invention has a viscosity index of preferably 130 to 250, preferably 140 or greater, more preferably 150 or greater. If the lubricating oil composition of the present invention has a viscosity index of less than 130, it would be difficult to improve the fuel saving performance. If the lubricating oil composition of the present invention has a viscosity index of greater than 250, it would be deteriorated in evaporability and cause malfunctions due to the lack of dissolubility of additives and incompatibility with seal materials.

EXAMPLES

The present invention will be described more specifically with reference to the following Examples and Comparative Examples but not limited thereto.

Examples 1 to 8 and Comparative Examples 1 to 5

Table 1 sets forth the properties of the lubricating base oils used in Examples and Comparative Examples.

Various lubricating base oils and additives set forth in Table 2 were blended to prepare lubricating oil compositions of the present invention (Examples 1 to 8) and those for comparison (Comparative Examples 1 to 5). The content of the base oils are on the total base oil composition mass basis and the content of each additive is on the total lubricating oil composition mass basis.

The resulting compositions were each subjected to the following fatigue life test described in (1) below to evaluate the fatigue life thereof. The compositions were each subjected to the following extreme pressure property test described in (2) below to evaluate the initial extreme pressure properties and those after long time use. The oil compositions in the fresh state were used for the initial extreme pressure property evaluation, and the degraded oil compositions which had been degraded with ultrasonic shear wave were used for evaluation of the extreme pressure properties after long time use. The results of the evaluations are also set forth in Table 2 below.

(1) Fatigue Life Test (a) FZG

This test was carried out using an FZG test apparatus under the following conditions to evaluate the fatigue life of gears provided by the composition by measuring the time until pitching occurs on the gears.

[Conditions] Loading stage: 12, oil temperature: 120° C., revolution number: 620 rpm (b) Rolling-Contact Fatigue Test at an Elevated Temperature This test was carried out using a rolling-contact fatigue test apparatus under the following conditions to evaluate each of the compositions by measuring the generation life time of pitching. On the basis of the results of Comparative Example 1, the other compositions were compared therewith to calculate their ratios to Comparative Example 1.

Thrust needle bearing (surface pressure: 1.9 GPa, revolution number: 1.410 rpm, oil temperature: 120° C.)

(2) Extreme Pressure Property Test

This test was carried out using a four-ball extreme pressure test machine in accordance with ASTM D 2596 to measure the last non-seizure load (LNSL) of each lubricating oil composition at a revolution number of 1800.

(3) Oxidation Stability

This test was carried out in accordance with JIS K 2514 4. (Oxidation stability test for internal combustion engine oil) to measure the ratios of the kinematic viscosities.

TABLE 1

| Base Oil | | (A1) | (A2) | (NA) | (B) | (C) |
|---|---|---|---|---|---|---|
| Kinematic viscosity (40° C.) | mm2/s | 19.97 | 15.7 | 36.82 | 240.5 | 43.3 |
| (100° C.) | mm2/s | 4.290 | 3.858 | 6.52 | 20.4 | 9.2 |
| Viscosity index | | 123 | 144 | 131 | 98 | 202 |
| Pour point | ° C. | −17.5 | −20 | −15 | −12.5 | — |
| Sulfur content | mass ppm | <1 | <1 | <1 | 0.61% | — |
| n-d-M analysis | % $C_P$ | 80.7 | 92.3 | 78.4 | 73.2 | — |
| | % $C_N$ | 19.3 | 7.7 | 21.6 | 19.1 | — |
| | % $C_A$ | 0.0 | 0.0 | 0.0 | 7.7 | — |
| $^{13}$C-NMR analysis | | | | | — | — |
| CH | % | 9.7 | 8.1 | 7.5 | — | — |
| CH2 | | — | 76.1 | 79.3 | — | — |
| CH3 | | — | 15.8 | 13.2 | — | — |
| (CM2 main chain) | | 14.2 | 17.1 | 15.5 | — | — |
| Average Carbon number | | 28 | 27 | 33 | — | — |

TABLE 2

| | | Example 1 | Example 2 | Example 3 | Example 4 | Example 5 | Example 6 | Example 7 |
|---|---|---|---|---|---|---|---|---|
| Base Oil | (A1)[1)] | 78 | 68 | 68 | 68 | 68 | | 68 |
| | (A2)[2)] | | | | | | 66 | |
| | (NA)[3)] | | | | | | | |
| | (B)[4)] | 22 | 22 | 22 | 22 | 22 | 24 | 22 |
| | (C)[5)] | | 10 | 10 | 10 | 10 | 10 | 10 |
| Additives | (B1)[6)] | 4 | 4 | | | 4 | 4 | 3 |
| | (B2)[7)] | | | 4 | | | | |
| | (B2)[8)] | | | | 4 | | | |
| | ZDTP[9)] | 1.2 | 1.2 | 1.2 | 1.2 | 1.2 | 1.2 | 1.2 |
| | (G1)[10)] | 1 | 1 | 1 | 1 | 1 | 1 | 1 |
| | (F1)[11)] | 6 | 6 | 6 | 6 | | 6 | 6 |
| | (F2)[12)] | | | | | 3 | | |
| Kinematic viscosity of gas oil compositions $mm^2/s$ | (40° C.) | 39.3 | 40.0 | 40.0 | 40.0 | 37.0 | 35.1 | 40.4 |
| | (100° C.) | 7.1 | 7.4 | 7.4 | 7.4 | 7.1 | 7.0 | 7.4 |
| Viscosity index | | 146 | 153 | 153 | 153 | 158 | 166 | 152 |
| Four-ball method[13)] 18000 rpm | LWI | 652 | 577 | 510 | 482 | 470 | 519 | 586 |
| | WL | 3923 | 3089 | 3089 | 2452 | 2452 | 3089 | 3089 |
| (N) | LNSL | 1236 | 1236 | 1236 | 981 | 981 | 981 | 1236 |
| Four-ball (Wear scar diameter)[14)] 392N, 1800 rpm, 1 h | mm | 0.37 | 0.33 | | | | 0.34 | 0.29 |
| Falex test (Seizure load)[15)] A Method (290 rpm, 110° C.) | lb | 2410 | 2620 or more | 2460 | 2240 | | 2740 or more | 2740 or more |
| Oxidation Stability[16)] (ISOT: 150° C., 96 h) | (40° C.) | 1.03 | 1.18 | 1.03 | 1.04 | | 1.17 | 1.18 |
| Comparison by kinematic viscosity | (100° C.) | 1.03 | 1.12 | 1.04 | 1.06 | | 1.17 | 1.18 |
| FZG fatigue life test 620 rpm, 120° C., 12st. | h | 22 | 25.5 | 23 | 22 | 22 | 30 | 23 |
| Unisteel fatigue life test (needle) | L 10, min | 650 | 780 | 760 | 680 | 630 | 780 | 720 |

| | | Example 8 | Comparative Example 1 | Comparative Example 2 | Comparative Example 3 | Comparative Example 4 | Comparative Example 5 |
|---|---|---|---|---|---|---|---|
| Base Oil | (A1)[1)] | 68 | 68 | 68 | 25 | 20 | 68 |
| | (A2)[2)] | | | | | | |
| | (NA)[3)] | | | | 65 | 80 | |
| | (B)[4)] | 22 | 22 | 22 | | | 22 |
| | (C)[5)] | 10 | 10 | 10 | 10 | | 10 |
| Additives | (B1)[6)] | 2 | 1 | 0 | 4 | 4 | 4 |
| | (B2)[7)] | | | | | | |
| | (B2)[8)] | | | | | | |

TABLE 2-continued

| | | | | | | | |
|---|---|---|---|---|---|---|---|
| | ZDTP[9] | 1.2 | 1.2 | 1.2 | 1.2 | 1.2 | 1.2 |
| | (G1)[10] | 1 | 1 | 1 | 1 | 1 | |
| | (F1)[11] | 6 | 6 | 6 | | | 6 |
| | (F2)[12] | | | | 3 | 3 | |
| Kinematic viscosity of gas oil compositions $mm^2/s$ | (40° C.) | 39.9 | 40.1 | 39.4 | 36.8 | 38.9 | 40.0 |
| | (100° C.) | 7.4 | 7.4 | 7.3 | 7.3 | 7.4 | 7.4 |
| Viscosity index | | 151 | 151 | 150 | 166 | 160 | 153 |
| Four-ball method[13] | LWI | 585 | 505 | 465 | 583 | 551 | 378 |
| 18000 rpm | WL | 3089 | 3089 | 2452 | 3089 | 2452 | 1961 |
| (N) | LNSL | 1236 | 981 | 981 | 1236 | 981 | 785 |
| Four-ball (Wear scar diameter)[14] 392N, 1800 rpm, 1 h | mm | 0.32 | 0.33 | 0.45 | | | 0.33 |
| Falex test (Seizure load)[15] A Method (290 rpm, 110° C.) | lb | 2460 | 2050 | 1770 | | | 1650 |
| Oxidation Stability[16] (ISOT: 150° C., 96 h) | (40° C.) | 1.18 | 2.85 | 2.51 | 1.18 | 1.03 | |
| Comparison by kinematic viscosity | (100° C.) | 1.17 | 2.67 | 2.14 | 1.12 | 1.03 | |
| FZG fatigue life test 620 rpm, 120° C., 12st. | h | 22.5 | 15 | 18 | 16 | | |
| Unisteel fatigue life test (needle) | L 10, min | 700 | 530 | 500 | 540 | 460 | |

[1] 100° C. Kinematic viscosity: 4.3, Viscosity index: 123, % $C_A$: O, tertiary carbon content: 9.7
[2] 100° C. Kinematic viscosity: 3.9, Viscosity index: 144, % $C_A$: O, tertiary carbon content: 8.1
[3] 100° C. Kinematic viscosity: 6.5, Viscosity index: 131, % $C_A$: O, tertiary carbon content: 7.5
[4] 100° C. Kinematic viscosity: 20.4, Viscosity index: 98, % $C_A$: 7.7
[5] Oleic acid ester of trimethylol propane
[6] Ca sulfonate base number: 300, Ca content: 12.1%
[7] Ca phenate base number: 150, Ca content: 5.3%
[8] Ca salicylate base number: 175, Ca content: 6.3%
[9] mixture of sec C3-C6 and pri C4-C8
[10] sulfurized olefin
[11] MW: 20,000 polymethacrylate
[12] MW: 50,000 polymethacrylate
[13] ASTM D2783
[14] ASTM D4172
[15] ASTM D3233
[16] JIS K2514

APPLICABILITY IN THE INDUSTRY

The gear oil composition of the present invention is a type of lubricating oil composition which is novel and, has a fuel saving performance.

The invention claimed is:

1. A gear oil composition comprising:

a base oil comprising a blend of (A) a mineral lubricating base oil having a 100° C. kinematic viscosity of 2 to 6 $mm^2/s$, a % CA of 0.5 or less and a tertiary carbon content of 7% or more; (B) a solvent-refined mineral lubricating oil having a 100° C. kinematic viscosity of 10 to 70 $mm^2/s$ in an amount of 2 to 40 percent by mass on the total base oil composition mass basis; and (C) an ester-based base oil having a 100° C. kinematic viscosity of 2 to 10 $mm^2/s$ in an amount of 5 to 20 percent by mass on the total base oil composition mass;

(D) zinc dialkyldithiophosphate in an amount of 0.02 to 0.5 percent by mass on the zinc amount basis; and (E) an alkaline earth metal detergent having a base number of 100 mgKOH/g or greater and a metal ratio of 2.5 or larger in an amount of 0.1 to 0.5 percent by mass on the metal amount basis, on the gear oil composition mass basis, wherein (C) the ester-based base oil is an ester of a monohydric fatty acid having 12 to 18 carbon atoms and a polyhydric aliphatic alcohol.

2. The gear oil composition according to claim 1, wherein the ester-based base oil is a polyhydric alcohol ester-based base oil.

3. The gear oil composition according to claim 1, wherein (E) the alkaline earth metal detergent is calcium sulfonate.

4. The gear oil composition according to claim 1 further comprising (F) a poly(meth)acrylate-based viscosity index improver containing structural units derived from a monomer represented by formula (2) in an amount of 0.1 to 15 percent by mass on the total gear oil composition mass basis:

(2)

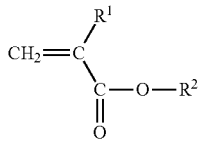

wherein $R^1$ is hydrogen or methyl, but the poly(meth)acrylate contains in its structural unit at least a structural unit wherein $R^2$ is a hydrocarbon group having 20 or more carbon atoms, and $R^2$ is a hydrocarbon group having 1 to 30 carbon atoms, but the poly(meth)acrylate contains in its structural unit at least a structural unit wherein $R^2$ is a hydrocarbon group having 20 or more carbon atoms.

5. The gear oil composition according to claim 1 further comprising (G) a sulfurized olefin in an amount of 0.1 to 2 percent by mass on the total gear oil composition mass basis.

* * * * *